US010488010B2

(12) United States Patent
Yvon et al.

(10) Patent No.: US 10,488,010 B2
(45) Date of Patent: Nov. 26, 2019

(54) LIGHT SOURCE ASSEMBLY FOR VEHICLE LAMP, METHOD FOR PRODUCING LIGHT SOURCE ASSEMBLY, SIGNAL LAMP FOR AUTOMOBILE VEHICLE

(71) Applicant: Foshan Ichikoh Valeo Auto Lighting Systems Co., Ltd., Foshan (CN)

(72) Inventors: Sylvain Yvon, Foshan (CN); Lixian Liu, Foshan (CN); Chunming-Parker Zhang, Foshan (CN)

(73) Assignee: Foshan Ichikoh Valeo Auto Lighting Systems Co., Ltd., Foshan (CN)

( * ) Notice: Subject to any disclaimer, the term of this patent is extended or adjusted under 35 U.S.C. 154(b) by 282 days.

(21) Appl. No.: 15/457,424

(22) Filed: Mar. 13, 2017

(65) Prior Publication Data

US 2017/0261174 A1 Sep. 14, 2017

(30) Foreign Application Priority Data

Mar. 14, 2016 (CN) ..... 2016 1 0144659
Mar. 14, 2016 (CN) ..... 2016 1 0144676
Mar. 14, 2016 (CN) ..... 2016 1 0144688

(51) Int. Cl.
*F21S 43/19* (2018.01)
*F21S 43/20* (2018.01)
(Continued)

(52) U.S. Cl.
CPC ..... *F21S 43/195* (2018.01); *F21S 43/20* (2018.01); *F21S 43/237* (2018.01);
(Continued)

(58) Field of Classification Search
CPC ..... F21S 43/195; F21S 43/237; F21S 43/247
See application file for complete search history.

(56) References Cited

U.S. PATENT DOCUMENTS 9,281,615 B1 * 3/2016 Plaza ..... H01R 13/6275
2009/0116255 A1 * 5/2009 Kearns ..... B60Q 3/82 362/490
(Continued)

FOREIGN PATENT DOCUMENTS

CN 102102838 A 6/2011
CN 102135144 A 7/2011
(Continued)

OTHER PUBLICATIONS

European Search Report dated Aug. 23, 2017 in European Patent Application No. 17160420, 2 pages.
(Continued)

*Primary Examiner* — Robert J May
*Assistant Examiner* — Leah Simone Macchiarolo
(74) *Attorney, Agent, or Firm* — Oblon, McClelland, Maier & Neustadt, L.L.P.

(57) ABSTRACT

The present disclosure provides a light source assembly for a vehicle lamp, a method for producing a light source assembly, and a signal lamp for an automobile vehicle. The light source assembly for a vehicle lamp includes: a base body; at least one metal holding member, each of which includes a light source holding part and one or more penetration parts, the light source holding part being arranged on a first surface of the base body, the penetration part penetrating through the base body from the first surface of the base body and extending outwardly from a second surface of the base body, the second surface being opposite to the first surface; and a light emitting component mounted on the light source holding part of the at least one metal holding member.

20 Claims, 6 Drawing Sheets

(51) Int. Cl.
*F21S 43/14* (2018.01)
*F21S 43/243* (2018.01)
*F21S 43/237* (2018.01)
*F21S 45/49* (2018.01)

(52) U.S. Cl.
CPC ..... *F21S 43/243* (2018.01); *F21S 45/49* (2018.01); *F21S 43/14* (2018.01)

(56) References Cited

U.S. PATENT DOCUMENTS

2011/0058387 A1* 3/2011 Matsunaga ..... F21K 9/00 362/547
2011/0128754 A1* 6/2011 Aiso ..... F21S 41/143 362/547
2011/0175529 A1* 7/2011 Hayashi ..... F21V 19/003 315/77
2013/0301290 A1* 11/2013 Lee ..... F21S 41/192 362/549
2015/0103552 A1* 4/2015 Aiso ..... F21S 45/48 362/549
2015/0369459 A1 12/2015 Huang et al.
2016/0061436 A1 3/2016 Hino
2017/0356615 A1* 12/2017 Min ..... F21S 43/14
2018/0106465 A1* 4/2018 Ozawa ..... F21V 29/763

FOREIGN PATENT DOCUMENTS

EP 2 990 725 A1 3/2016
JP 2011-129308 A 6/2011
WO WO 2013/035936 A1 3/2013

OTHER PUBLICATIONS

Combined Chinese Office Action and Search Report issued Jan. 25, 2019 in Chinese Patent Application No. 201610144688.X (with English translation of Category of Cited Documents), 9 pages.

* cited by examiner

LIGHT SOURCE ASSEMBLY FOR VEHICLE LAMP, METHOD FOR PRODUCING LIGHT SOURCE ASSEMBLY, SIGNAL LAMP FOR AUTOMOBILE VEHICLE

BACKGROUND OF THE DISCLOSURE

Field of the Disclosure

The present disclosure relates to a technical field of vehicle lamp, and in particular to a light source assembly for a vehicle lamp, a method for producing a light source assembly and a signal lamp for an automobile vehicle.

Description of the Related Art

A light source is a necessary component in various lighting apparatuses and/or optical indicators, for supplying light for lighting and/or optical indication. In a vehicle lamp for an automobile vehicle, the light source is significant for the design of the vehicle lamp. In particular, applications of light emitting components with low energy consumption and high luminance (such as light emitting diodes) in recent years give more rigorous requirements on the design of the light source. The design of the light source not only needs to satisfy the requirements on luminance, but also needs to satisfy the requirements on design of the heat dissipation and structures. In the prior art, the light emitting diodes are often carried on a printed circuit board with a sophisticated structure, thus the production of the light source component becomes complicated and its structure becomes limited.

A signal lamp for an automobile vehicle is a crucial device for ensuring the automobile vehicle to travel in conformity with traffic regulations. As semiconductor light emitting technology develops continuously, more and more light emitting components with low energy consumption and high luminance (such as light emitting diodes) are applied in the signal lamp for an automobile vehicle. In the conventional signal lamp for an automobile vehicle, the light emitting diodes are provided on a special printed circuit board and a heat sink with a high volume may often be needed, which causes complicated production and assembly.

SUMMARY

The present disclosure is intended to provide a light source assembly for a vehicle lamp, which replaces the printed circuit board by a metal holding member to hold a light emitting component directly, so as to simplify the structure of system and improve work reliability of the assembly.

The present disclosure is also intended to provide a signal lamp for an automobile vehicle, which has a simple structure, low cost and good reliability.

The present disclosure is also intended to provide a method for producing a light source assembly, which reduces the difficulty and cost of producing the light source assembly by means of injection moulding of metal holding members and a base body.

An embodiment of the present disclosure provides a light source assembly for a vehicle lamp, including: a base body; at least one metal holding member, each of which includes a light source holding part and one or more penetration part, the light source holding part being arranged on a first surface of the base body, the penetration part penetrating through the base body from the first surface of the base body and extending outwardly from the second surface of the base body, the second surface being opposite to the first surface; and a light emitting component mounted on the light source holding part of the at least one metal holding member.

In an embodiment, the at least one metal holding member includes a first metal holding member and a second metal holding member, the light emitting component has two electrodes that are electrically connected to the first metal holding member and the second metal holding member respectively, and the first metal holding member and the second metal holding member are electrically isolated from each other.

In an embodiment, the first metal holding member has two penetration parts parallel to each other and the second metal holding member has one penetration part.

In an embodiment, the penetration part of the at least one metal holding member forms a metal radiating fin.

In an embodiment, the base body is provided with base body radiating fins on the second surface.

In an embodiment, the penetration parts and the base body radiating fins extend in substantially parallel to each other and are spaced apart from each other.

In an embodiment, the penetration part and the base body radiating fins extend in a direction substantially perpendicular to the second surface of the base body.

In an embodiment, the penetration part passes through a groove arranged at a periphery of the base body or through an aperture arranged at a central location of the base body.

In an embodiment, the light source assembly further includes: a driving device arranged to drive the light emitting component to emit light, wherein a connector is provided on the first surface of the base body and electrically connected to the driving device by a harness.

In an embodiment, the base body is provided with one or more mounting holes penetrating the first surface and the second surface, for being connected to a light guide device.

In an embodiment, the light emitting component is a light emitting diode.

In an embodiment, the base body is made from plastic.

In an embodiment, the plastic is thermoconductive plastic which is electrically isolated or dielectric.

In an embodiment, the base body is made from a thermoplastic resin with thermally conductive fillers dispersed in the resin.

In an embodiment, the base body and the at least one metal holding member are formed in single piece.

An embodiment of the present application provides a signal lamp for an automobile vehicle, including: a housing; an outer lens, the outer lens and the housing in combination enclosing an internal space of the signal lamp; and the light source assembly as described in any of the above embodiments, the light source assembly located in the internal space of the signal lamp and arranged to emit a signaling light which exits the signal lamp through the outer lens.

In an embodiment, the signal lamp further includes a light guide device located in the internal space of the signal lamp and arranged to receive the signaling light emitted from the light source assembly and to direct the signaling light towards the outer lens, wherein the base body is provided with one or more mounting holes penetrating the first surface and the second surface and the light guide device is connected to the light source assembly via the mounting holes.

In an embodiment, the light guide device has a tubular shape and an end face for receiving the signaling light emitted from the light source assembly.

In an embodiment, the end face of the light guide device is provided with a light coupling collimator.

In an embodiment, the signal lamp further includes a bezel located at an inner side of the outer lens and fixed to the outer lens, the light guide device being provided with a connecting tab, by which the light guide device is fixed to the bezel.

In an embodiment, the signal lamp for an automobile vehicle is a center high mounted stop lamp, a rear stop lamp, a direction signal lamp or a position lamp.

An embodiment of the present application provides a method for producing a light source assembly, including: a) forming at least one metal holding member, each of which includes a light source holding part extending in a first direction and one or more penetration part extending in a second direction crossing the first direction; b) putting the at least one metal holding member in a die cavity and injecting a material for a base body into the die cavity to form the base body of the light source assembly on a side of the light source holding part by injection moulding, the base body being penetrated therethrough by the penetration part of the metal holding member; and c) mounting a light emitting component on a side of the light source holding part of the metal holding member opposite to the base body.

In an embodiment, the at least one metal holding member includes a first metal holding member and a second metal holding member spaced apart from each other, the light emitting component has two electrodes, and in the step c), the two electrodes of the light emitting component are electrically connected to the first metal holding member and the second metal holding member respectively.

In an embodiment, in the step b), base body radiating fins are formed on a side of the base body facing away from the light source holding part.

In an embodiment, the penetration part and the base body radiating fins extend in substantially parallel to each other and are spaced apart from each other.

In an embodiment, the first direction is substantially perpendicular to the second direction.

In an embodiment, in the step b), a connector socket for the light emitting component is formed on the base body.

In an embodiment, the method further includes: d) producing a driving device for driving the light emitting component and soldering one end of a harness to the driving device; and e) connecting the other end of the harness to the connector socket on the base body.

In an embodiment, the step b) includes forming one or more mounting holes in the base body, for connecting a light guide device.

In an embodiment, the light emitting component is a light emitting diode.

In an embodiment, the base body is made from plastic.

In an embodiment, the plastic is thermoconductive plastic which is electrically isolated or dielectric.

In an embodiment, the base body is made from a thermoplastic resin with thermally conductive fillers dispersed in the resin.

In the light source assembly and the signal lamp for an automobile vehicle as described in any of the above embodiments, the light emitting component is held by a multi-functional metal holding member in place of the printed circuit board with a sophisticated structure, so as to simplify the structure of the signal lamp device and to improve its reliability.

With the method for producing a light source assembly as described in any of the above embodiments, the base body and the multi-functional metal holding member are formed by injection moulding into the single part used to mount the light emitting component thereon, so as to avoid the process for producing and using the printed circuit board with a sophisticated structure for holding the light emitting component. In this way, the process for producing the light source assembly can be simplified and the cost can be saved.

DETAILED DESCRIPTION OF PREFERRED EMBODIMENTS

Figure 1:
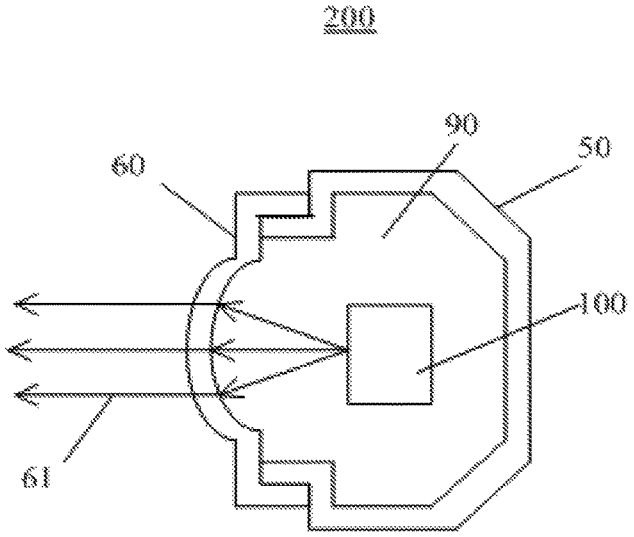
FIG. 1 is a principle schematic view showing a signal lamp for an automobile vehicle according to an embodiment of the present application.

Embodiments of the present application will below be explained in details by ways of examples with reference to the accompanied drawings. Throughout the description, same or similar reference numerals represent same or similar parts. The following description of the embodiments with reference to the drawings is intended to explain the general inventive concept of the present application, instead of limiting to the present invention.

In accordance with a general concept of the present application, it provides a light source assembly for a vehicle lamp, including: a base body; at least one metal holding member, each of which includes a light source holding part and one or more penetration parts, the light source holding part being arranged on a first surface of the base body, the penetration part penetrating through the base body from the first surface of the base body and extending outwardly from a second surface of the base body, the second surface being opposite to the first surface; and a light emitting component mounted on the light source holding part of the at least one metal holding member.

In accordance with a general concept of the present application, it further provides a signal lamp for an automobile vehicle, including: a housing; an outer lens, the outer lens and the housing in combination enclosing an internal space of the signal lamp; and a light source assembly for a vehicle lamp, the light source assembly located in the internal space of the signal lamp and arranged to emit a signaling light which exits the signal lamp through the outer lens, wherein the light source assembly includes: a base body; at least one metal holding member, each of which includes a light source holding part and one or more penetration parts, the light source holding part being arranged on a first surface of the base body, the penetration part penetrating through the base body from the first surface of the base body and extending outwardly from a second surface of the base body, the second surface being opposite to the first surface; and a light emitting component mounted on the light source holding part of the at least one metal holding member.

In accordance with a general concept of the present application, it further provides a method for producing a light source assembly, including: a) forming at least one metal holding member, each of which includes a light source holding part extending in a first direction and one or more penetration parts extending in a second direction crossing the first direction; b) putting the at least one metal holding member in a die cavity and injecting a material for a base body into the die cavity to form the base body of the light source assembly on a side of the light source holding part by injection moulding, the base body being penetrated therethrough by the penetration parts of the metal holding member; and c) mounting a light emitting component on a side of the light source holding part of the metal holding member opposite to the base body.

In addition, in the following detailed description, for purposes of explanation, numerous specific details are set forth in order to provide a thorough understanding of the disclosed embodiments. It will be apparent, however, that one or more embodiments may be practiced without these specific details.

FIG. 1 is a principle schematic view showing a signal lamp for an automobile vehicle. In an example, a housing 50 and an outer lens 60 in combination encloses an internal space 90 of the signal lamp. A light source assembly 100 is located in the internal space 90 of the signal lamp and arranged to emit a signaling light 61 which exits the signal lamp through the outer lens 60. As an example, the light emitted from the light source assembly 100 may exit from the outer lens 60 directly, or may exit from the outer lens 60 after it is directed by an optical transmission device (for example a light guide device).

Figure 2:
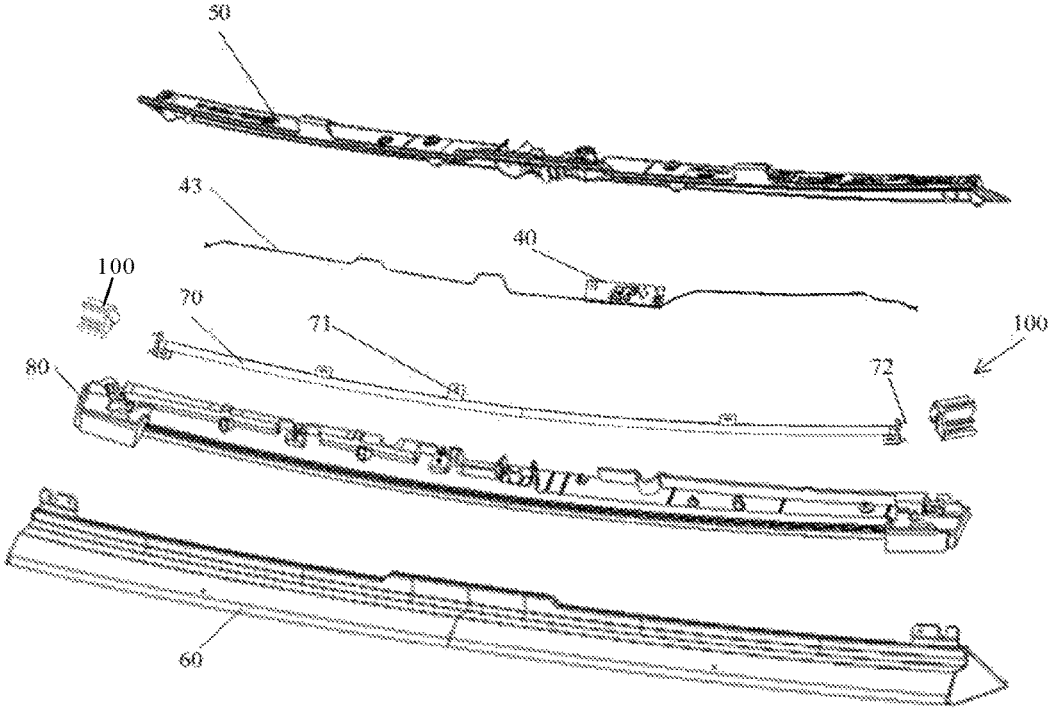
FIG. 2 is a schematic exposed view showing components of a signal lamp for an automobile vehicle according to an embodiment of the present application.

FIG. 2 is a schematic exposed view showing a signal lamp for an automobile vehicle according to an embodiment of the present application. In the embodiment shown in FIG. 2, the signal lamp is a center high mounted stop lamp. FIG. 2 shows the housing 50, the outer lens 60 and the light source assembly 100. FIG. 2 also shows optional components that may be included in the signal lamp for an automobile vehicle, such as a light guide device 70, a bezel 80 and the like. More details of the light source assembly 100 are shown in FIGS. 3-6.

Figure 3:
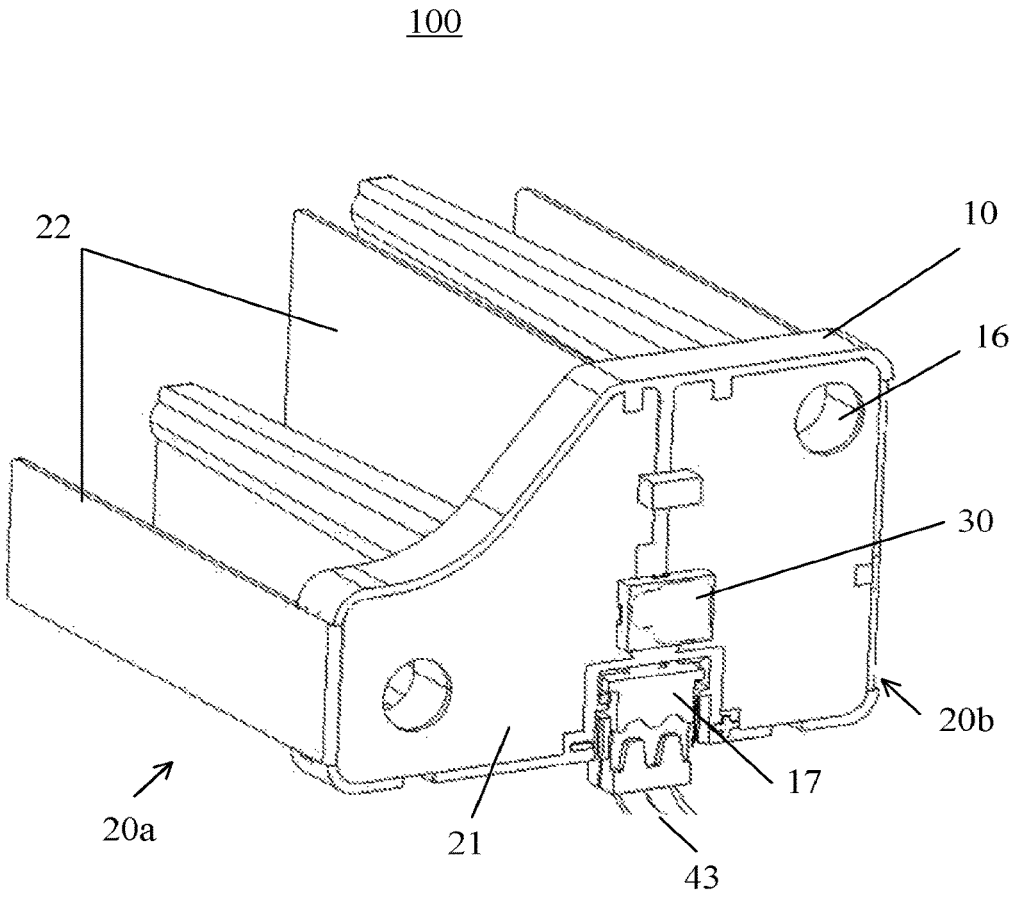
FIG. 3 is a schematic perspective view showing a light source assembly for a vehicle lamp according to an embodiment of the present application.
Figure 4:
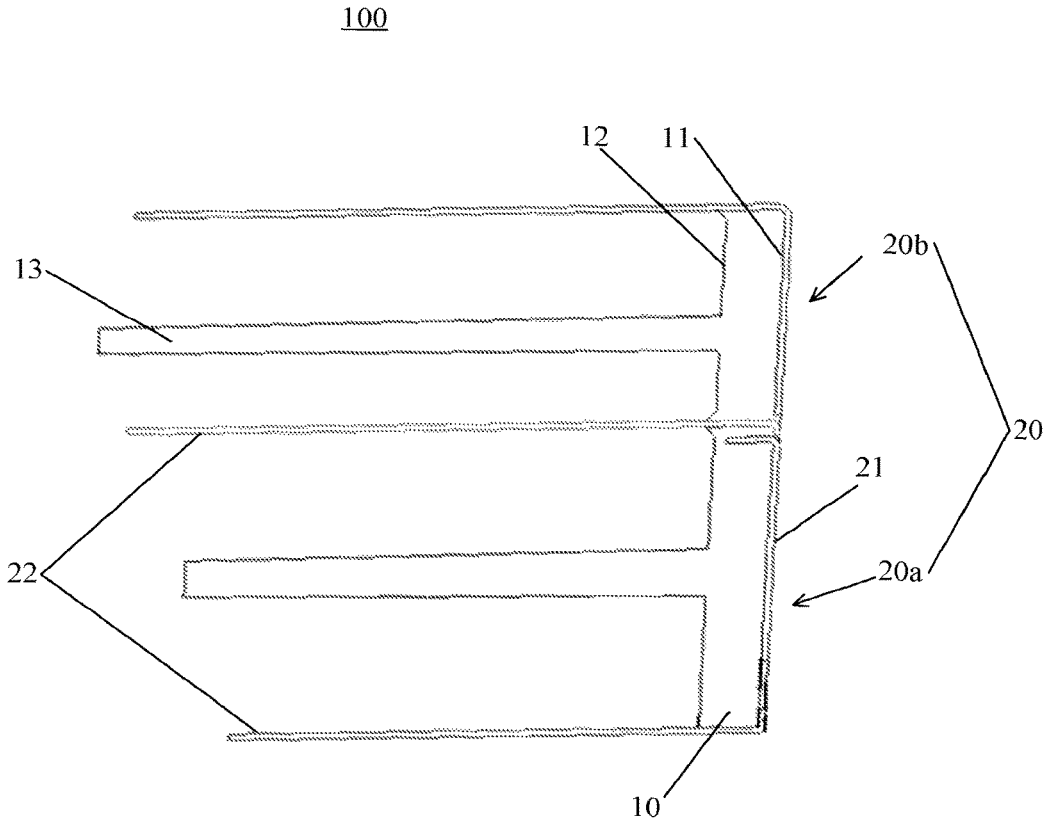
FIG. 4 is a schematic side cross sectional view showing a light source assembly for a vehicle lamp according to an embodiment of the present application.
Figure 5:
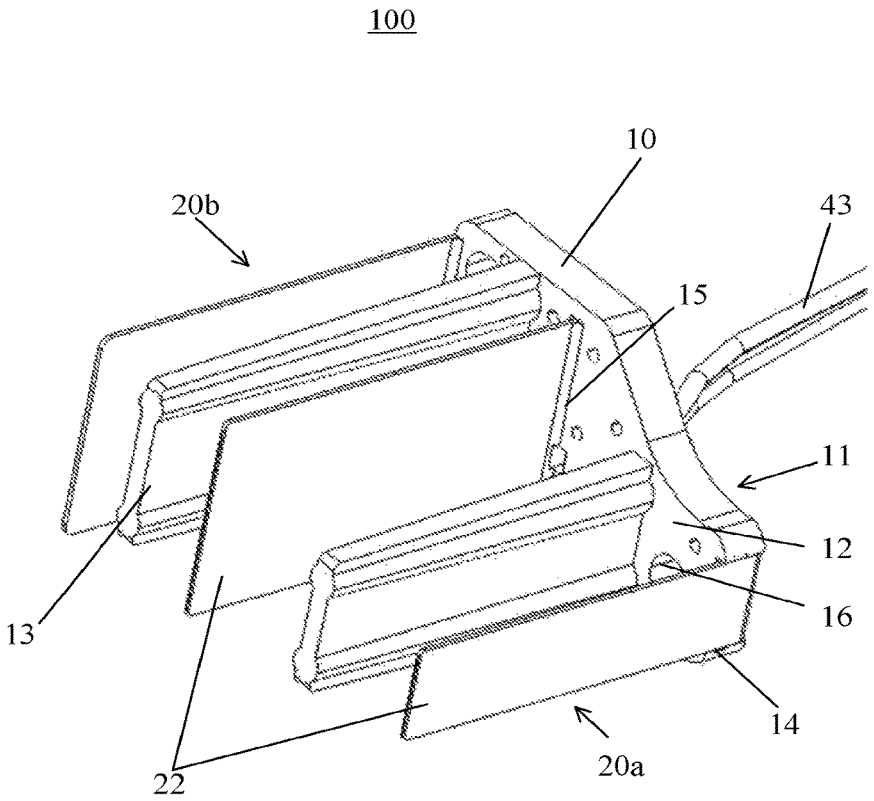
FIG. 5 is another schematic perspective view showing a light source assembly for a vehicle lamp according to an embodiment of the present application.

FIGS. 3-5 schematically show a light source assembly 100 for a vehicle lamp according to an embodiment of the present application. For example, the light source assembly 100 may be used in the signal lamp 200 for an automobile vehicle. The light source assembly 100 includes: a base body 10; at least one metal holding member 20, each of which includes a light source holding part 21 and one or more penetration parts 22, the light source holding part 21 being arranged on a first surface 11 of the base body 10, the penetration part 22 penetrating through the base body 10 from the first surface 11 of the base body 10 and extending outwardly from a second surface 12 of the base body 10, the second surface 12 being opposite to the first surface 11; and a light emitting component 30 (for example an light emitting diode) mounted on the light source holding part 21 of the at least one metal holding member 20.

In the above embodiment, the light emitting component 30 is held or carried on the base body 10 by the metal holding member 20. In this way, a printed circuit board for holding the light emitting component 30 may be removed. As an example, the base body 10 may be used to form a heat sink. On one hand, the metal holding member 20 may function to support the light emitting component 30 (by the light source holding part 21), and on the other hand, the metal holding member 20 may also form other functional structures such as radiating fins on the second surface 12 of the base body 10 by means of the penetration part 22. The metal holding member 20 may for example be made of a metal sheet. Such metal holding member 20 with multi-functions may simplify the structure of the light source assembly 100 efficiently.

In an example, the at least one metal holding member 20 may include a first metal holding member 20*a* and a second metal holding member 20*b*, as shown in FIG. 4. Correspondingly, the light emitting component 30 (for example, the light emitting diode) has two electrodes that are electrically connected to the first metal holding member 20*a* and the second metal holding member 20*b* respectively, the first metal holding member 20*a* and the second metal holding member 20*b* being electrically isolated from each other. In this example, the first metal holding member 20*a* and the second metal holding member 20*b* are electrically conductive and thus may provide electrical connection for the light emitting component 30. However, embodiments of the present application are not limited to this, for example, pins or wires may also be lead out from the electrodes of the light emitting component 30 at a location of the base body 10 being in noncontact with the metal holding member 20 to achieve the electrical connection of the light emitting component 30.

In the example shown in FIG. 5, the first metal holding member 20*a* has two penetration parts 22 parallel to each other and the second metal holding member 20*b* has one penetration part 22. Such arrangement forms three penetration parts 22, which extend substantially perpendicular to the second surface 12, on the side of the base body 10 on which the second surface 12 is located. However, the number of the penetration parts 22 is not limited to this. Alternatively, each of the metal holding members may have any other number of the metal holding members. The numbers of the penetration parts of respective metal holding members may be same or different from each other.

Although the metal holding members 20 have been explained with reference to the first metal holding member 20*a* and the second metal holding member 20*b* in the above embodiments, it should be understood by the skilled person in the art that the number of the metal holding members 20 is not limited to two, for example, one, three, four or more metal holding members 20 may be provided as required.

In an example, the penetration part 22 of the at least one metal holding member 20 forms a metal radiating fin. As the light emitting component 30 produces heat in work, the radiating fins are often needed. In the example, the metal holding member 20 has the functions of both holding the light emitting component 30 and dissipating heat such that the light source assembly 100 becomes compact in structure.

In order to form a better heat dissipation passage, the base body 10 may be further provided with base body radiating fins 13 on the second surface 12, besides the metal radiating fins formed by the penetration parts 22. As illustrated in FIG. 5, the base body radiating fins 13 and the metal radiating fins may be arranged alternately. As an example, the penetration parts 22 and the base body radiating fins 13 may extend in substantially parallel to each other and spaced apart from each other. In an example, the penetration parts 22 and the base body radiating fins 13 may extend in a direction substantially perpendicular to the second surface 12 of the base body 10, for example, inclined at an angle between 80 degrees and 100 degrees with respect to the second surface 12.

In an example, the penetration part 22 may extend through a groove 14 arranged at a periphery of the base body 10 or through an aperture 15 arranged at a central location of the base body 10, so as to penetrate through the base body 10, as shown in FIG. 5.

In an example, the base body 10 may be provided with one or more mounting holes 16 penetrating through the first surface 11 and the second surface 12. In the vehicle lamp of an automobile vehicle, in order to improve the illumination or lit effects, it is often desired to direct the light emitted from the light emitting component 30 into a light guide device 70 and then the light exits from the light guide device 70 after the light is distributed by the light guide device 70. So-called light guide device means an optical component that can direct light mainly by internally total reflection in its interior. It may have various shapes, such as of a cylinder (may be called as light guide rod), a bar (may be called as light guide bar, light bar), a plate (may be called as light guide plate), a ring (may be called as light guide ring), and the like. Since the light is directed mainly by internally total reflection in the interior of the light guide device, the light guide device has high efficiency and low optical loss. In the light guide device, it typically needs an incident light meets the total reflection condition at the outer wall of the light guide device, however, when the light in the interior of the light guide device exits from a designated position, the light will typically not meet the total reflection condition at the designated position any longer. For example, the light may be incident into the light guide device from one end and totally reflected by the light guide device 70 continuously. Light decoupling components (for example prisms) may also be provided on at least one region on a side of the light guide device 70. The light decoupling components have a function of destroying the total reflection condition of the light in the light guide device 70 such that the light reflected by the light decoupling components onto the side of the light guide device opposite to the light decoupling components exits from the light guide device 70 in place of being reflected totally. The light decoupling components may be arranged such that the light can exit from the light guide device 70 at a suitable position. The light guide device 70 may emit the light over an entire length thereof. A certain light may be reflected at many times before it exits the light guide device, as it travels in the light guide device. The light guide device 70 may impart the exit light from the signal lamp 200 for an automobile vehicle (such as a car) with improved uniformity and desired lit effects.

The mounting holes 16 provided in the base body 10 may be used for connection to the light guide device 70. Correspondingly, a mounting protrusion 72 may be arranged at an end of the light guide device 70. The metal holding member 20 with the light emitting component 30 and the base body 10 may be mounted on the light guide device 70 by cooperating the mounting protrusion 72 with the mounting hole 16 arranged on the base body 10. If required, the mounting hole 16 may penetrate through the light source holding part 21 of the metal holding member 20.

In an example, the light guide device 70 has a tubular shape and an end face 73 for receiving the signaling light emitted from the light source assembly. As an example, the end face 73 may be planar. The end face 73 may be provided with a light coupling collimator, so that the light can be incident into the light guide device 70 at a suitable angle. For example, the end face 73 may be arranged as a curve dioptric face similar to a lens face, or may be provided with a collimator such as a self-focusing lens.

In an example shown in FIG. 2, a bezel 80 is also shown. The bezel 80 is located at an inner side of the outer lens 60 and fixed to the outer lens 60. The light guide device 70 may be provided with a connecting tab 71. The light guide device 70 may be fixed to the bezel 80 by the connecting tab 71. On one hand, the bezel 80 may have a function of connecting and fixing the light guide device 70, and on the other hand, it may also improve an appearance of the signal lamp 200 for an automobile vehicle.

Figure 6:
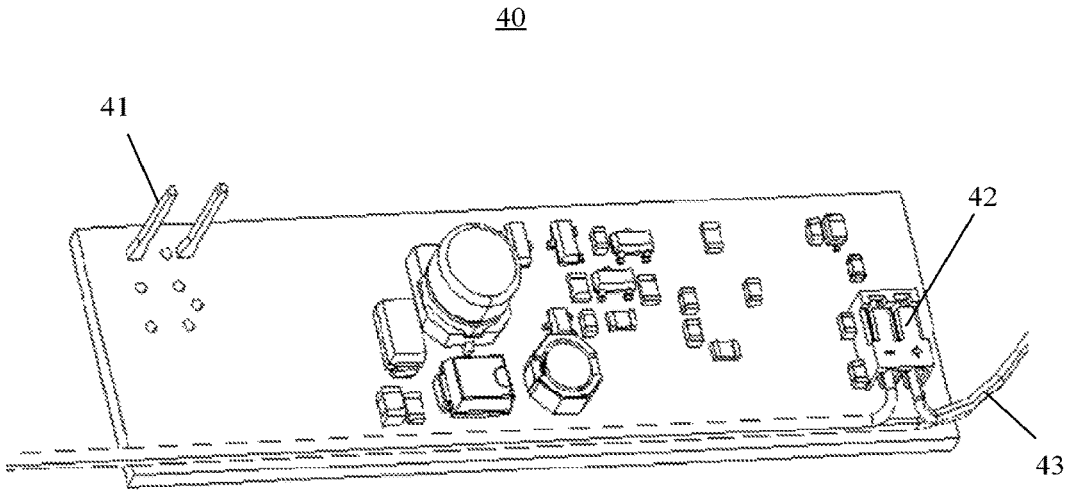
FIG. 6 is a schematic view showing a driving device of a light source assembly for a vehicle lamp according to an embodiment of the present application.

In an embodiment, the light source assembly 100 may include a driving device 40, as shown in FIG. 6. The driving device 40 may for example be a driving circuit board provided with a light source driving chip and may be arranged to drive the light emitting component 30 to emit light. The driving device 40 may for example include a power supply plug 41 and a harness plug 42. The power supply plug 41 may supply power for the driving device 40 and the harness plug 42 is connected to the light emitting component 30 by a harness 43. As an example, a connector 17 may further be provided on the first surface 11 of the base body 10 (as shown in FIG. 3) and electrically connected to the driving device 40 by the harness 43. In the above example, the driving device 40 may be spaced apart physically from the metal holding member 20 mounted with the light emitting component 30 and the base body 10 and may be electrically connected with the metal holding member 20 mounted with the light emitting component 30 and the base body 10 by the harness 43. It is advantageous for design of the vehicle lamp of an automobile vehicle. In the conventional design of the vehicle lamp, the requirements for compactness of space become more and more rigorous. In such arrangement in the above example, the light emitting component 30 may be arranged in a compact space (for example, at an end of the light guide device) while the driving device 40 may be arranged in a wide space apart from the light emitting component at a certain distance. It may improve space utilization. It may also facilitate one driving device 40 to drive a plurality of light emitting components 30 at different positions in the vehicle lamp. The driving device 40 may include any known circuit devices in the art required for driving the light emitting component 30, such as resistors, driving chips, capacitors or the like.

In the example shown in FIG. 2, each of two ends of the light guide device 70 is provided with one light emitting component and two light emitting components at the two ends may both be driven by a same driving device 40.

In an embodiment of the present application, the light emitting component 30 may be a component that can emit light, such as a light emitting diode. The light emitting component 30 may be mounted on the metal holding member 20 by for example welding or adhesives. The embodiments of the present application are in particular applicable to a surface mounted light emitting component.

In an embodiment of the present application, the base body 10 may be made from a moldable insulation material such as plastic. It facilitates producing the base body 10 by molding. The metal holding member 20 may for example be made from a metal that is in solid phase in room temperature, such as copper, aluminum or titanium. The base body 10 and the metal holding member 20 may be formed into single piece, for example by injection molding.

In an example, the base body 10 may be made from thermoconductive plastic which is electrically isolated or dielectric (if the base body radiating fins 13 are provided, they may be formed by the thermoconductive plastic as a part of the base body 10). As an example, the thermoconductive plastic may have thermal conductivity above 10 $W \cdot m^{-1} \cdot K^{-1}$. In this way, the base body 10 may have relatively high thermal conducting efficiency, so as to improve heat dissipation of the light emitting component.

As an example, the base body 10 may be made from a thermoplastic resin. Thermally conductive fillers may be dispersed in the resin. The thermoplastic resin may be made from any material selected from, for example, polyamide, polyethylene, polyethylene terephthalate, polybutylene terephthalate, polyphthalamide or polyacrylic acid. The thermally conductive fillers may be made for example from boron nitride or zinc oxide. As an example, the thermally conductive fillers may be provided in the thermoplastic resin in form of particles. However, the materials of the thermoplastic resin and the thermally conductive fillers are not limited to those. Instead, any known materials suitable to the thermoplastic resin or the thermally conductive fillers may also be used.

In an embodiment of the present application, the light emitting component 30 is held by the metal holding member 20, thus, the printed circuit board for holding the light emitting component 30 is not needed such that the structure of the system can be simplified and the work reliability can be improved.

Figure 7:
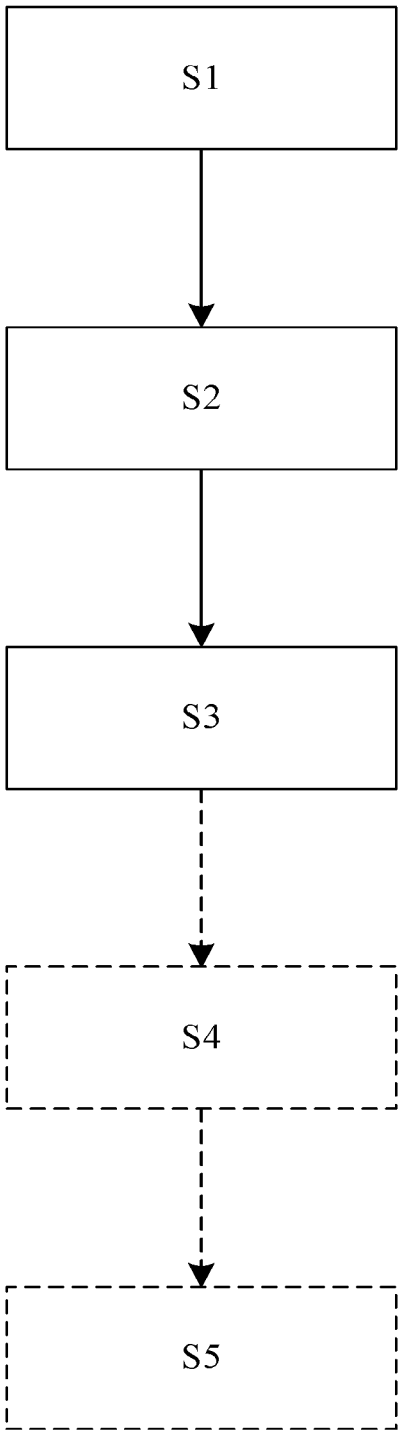
FIG. 7 is a flow chart of a method for producing a light source assembly according to an embodiment of the present application.
Figure 8:
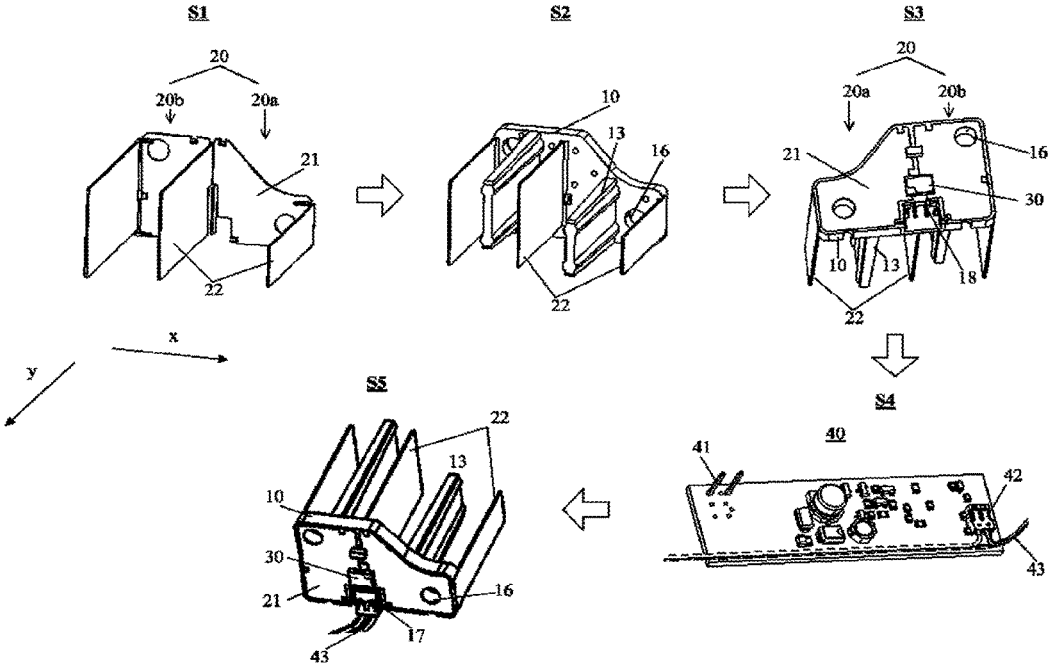
FIG. 8 is a schematic view showing products corresponding to the respective steps of the method for producing a light source assembly according to an embodiment of the present application.

FIGS. 7-8 show a method for producing a light source assembly according to an embodiment of the present application. The method for producing a light source assembly includes:

Step S1 of forming at least one metal holding member 20, each of which includes a light source holding part 21 extending in a first direction (for example the x direction shown in FIG. 8) and one or more penetration parts 22 extending in a second direction (for example the y direction shown in FIG. 8) crossing the first direction;

Step S2 of putting the at least one metal holding member 20 in a die cavity and injecting a material for a base body 10 into the die cavity to form the base body 10 of the light source assembly 100 on a side of the light source holding part 21 by injection moulding, the base body 10 being penetrated therethrough by the penetration parts 22 of the metal holding member 20; and Step S3 of mounting a light emitting component 30 on a side of the light source holding part 21 of the metal holding member 20 opposite to the base body 10.

In the above method according to the embodiment of the present application, the base body 10 and the metal holding member 20 are formed by injection moulding as a single piece for mounting the light emitting component 30, and the printed circuit board for holding the light emitting component 30 is not needed. This method provides a light source assembly with a simple structure and the process may be simplified and the cost may be saved.

In the light source component produced by the method, as an example, the light source holding part 21 may be configured to mount the light emitting component 30 and the penetration part 22 may be used as a heat sink. As an example, the light source holding part 21 and the penetration part 22 may be formed integrally as single piece, or may also be made separately and connected together by a connector. The metal holding member 20 may be made from a metal sheet. As an example, in the step S3, the light emitting component 30 may be mounted (for example, welded) on the metal holding member 20 in a surface mounted way.

In an example, the at least one metal holding member 20 may include a first metal holding member 20*a* and a second metal holding member 20*b* spaced apart from each other, the light emitting component 30 has two electrodes, and in the step S3, the two electrodes of the light emitting component 30 may be electrically connected to the first metal holding member 20*a* and the second metal holding member 20*b* respectively.

In an example, in the step S2, base body radiating fins 13 are formed on a side of the base body 10 facing away from the light source holding part 21. The base body radiating fins 13 may be combined with the penetration parts 22 to form heat dissipation passages to improve the effects of heat dissipation. As an example, the penetration parts 22 and the base body radiating fins 13 may extend in substantially parallel to each other and spaced apart from each other.

As an example, the first direction is substantially perpendicular to the second direction. That is, the penetration parts 22 of the metal holding member 20 may be located substantially perpendicular to the light source holding part 21.

In an example, in the step S2, a connector socket 18 for the light emitting component 30 is formed on the base body 10. The connector socket 18 may be electrically connected to the electrodes of the light emitting component 30.

As an example, the method for producing a light source assembly according to the embodiment of the present application may further include (as shown in block indicated by dashed lines in FIG. 7):

Step S4 of producing a driving device 40 and soldering one end of a harness 43 to the driving device 40; and Step S5 of connecting the other end of the harness 43 to the connector socket 18 on the base body 10.

As an example, the driving device 40 may include a driver printed circuit board. The driving device 40 is configured to drive the light emitting component 30 to emit the light. The driving device 40 may be produced by any known methods in the art, for example methods for producing a printed circuit board.

In an example, in the step S2, one or more mounting holes 16 are formed in the base body 10, for connecting the base body 10 with a light guide device.

In an embodiment of the present application, the light emitting component 30 may be a component that can emit light, such as a light emitting diode. The light emitting component 30 may be mounted on the metal holding member 20 by for example welding. The embodiments of the present application are in particular applicable to a surface mounted light emitting component.

In an embodiment of the present application, the base body 10 may be made from a moldable insulation material such as plastic. It facilitates producing the base body 10 by molding. The metal holding member 20 may for example be made from a metal that is in solid phase in a room temperature, such as copper, aluminum or titanium.

In an example, the base body 10 may be made from thermoconductive plastic which is electrically isolated or dielectric (if the base body radiating fins 13 are provided, they may be formed by the thermoconductive plastic as a part of the base body 10). As an example, the thermoconductive plastic may have thermal conductivity above 10 $W \cdot m^{-1} \cdot K^{-1}$. In this way, the base body 10 may have relatively high thermal conducting efficiency, so as to improve heat dissipation of the light emitting component.

As an example, the base body 10 may be made from a thermoplastic resin. Thermally conductive fillers may be dispersed in the resin. The thermoplastic resin may be made from any material selected from such as polyamide, polyethylene, polyethylene terephthalate, polybutylene terephthalate, polyphthalamide or polyacrylic acid. The thermally conductive fillers may be made for example from boron nitride or zinc oxide. As an example, the thermally conductive fillers may be provided in the thermoplastic resin in form of particles. However, the materials of the thermoplastic resin and the thermally conductive fillers are not limited to those. Instead, any known materials suitable to the thermoplastic resin or the thermally conductive fillers may also be used.

The light source assembly 100 in the signal lamp 200 for an automobile vehicle according to an embodiment of the present application may be produced by the following steps:

Step 1: forming at least one metal holding member 20, each of which includes a light source holding part 21 extending in a first direction and one or more penetration parts 22 extending in a second direction crossing the first direction;

Step 2: putting the at least one metal holding member 20 in a die cavity and injecting a material for a base body 10 into the die cavity to form the base body 10 of the light source assembly 100 on a side of the light source holding part 21 by injection moulding, the base 10 being penetrated therethrough by the penetration parts 22 of the metal holding member 20; and Step 3: mounting a light emitting component 30 on a side of the light source holding part 21 of the metal holding member 20 opposite to the base body 10.

In the above method, specific parameters for the injecting moulding process depend on the specific material of the base body 10. The skilled person in the art may determine the specific parameters of the injecting moulding process from the knowledge in the art depending on the specific material.

It can be known from the above producing method, that the signal lamp 200 for an automobile vehicle according to the embodiment of the present application may simplify the producing process and reduce the cost.

For the light source assembly 100 including the driving device 40, the method may further include the following steps:

Step 4: producing a driving device 40 and soldering one end of a harness 43 to the driving device 40; and Step 5: connecting the other end of the harness 43 to the connector socket 18 on the base body 10.

Although the above embodiment has been described with a center high mounted stop lamp (CHMSL) as an example, the signal lamp for an automobile vehicle according to the embodiment of the present application is not limited to the center high mounted stop lamp, and any other types of signal lamps for an automobile vehicle, such as a rear stop lamp, a direction signal lamp or a position lamp, are also applicable.

The present disclosure has been explained with reference to drawings. However, the examples shown in drawings are intended to exemplarily illustrate the embodiments of the present application by way of examples, instead of limiting the present invention.

Although some of embodiments according to a general concept of the present disclosure have been illustrated and explained, the skilled person in the art will understand that these embodiments may be modified without departing principles and spirits of the present disclosure. The scope of the prevent invention will be defined by the appended claims and equivalents thereof.

What is claimed is:

1. A light source assembly for a vehicle lamp, the light source assembly comprising:

a base body;

at least two metal holding members, each of which comprises a light source holding part and one or more penetration parts, the light source holding part being arranged on a first surface of the base body, the penetration part penetrating through the base body from the first surface of the base body and extending outwardly from a second surface of the base body, the second surface being opposite to the first surface, the at least two metal holding members being adjacent to each other and non-overlapping; and a light emitting component mounted on the light source holding part of the at least two metal holding members.

2. The light source assembly according to claim 1, wherein the at least two metal holding members include a first metal holding member and a second metal holding member, the light emitting component has two electrodes that are electrically connected to the first metal holding member and the second metal holding member respectively, and the first metal holding member and the second metal holding member are electrically isolated from each other.

3. The light source assembly according to claim 2, wherein the first metal holding member has two penetration parts parallel to each other and the second metal holding member has one penetration part.

4. The light source assembly according to claim 1, wherein the penetration part of the at least two metal holding members forms a metal radiating fin.

5. The light source assembly according to claim 4, wherein the base body is provided with base body radiating fins on the second surface.

6. The light source assembly according to claim 1, wherein the penetration part passes through a groove arranged at a periphery of the base body or through an aperture arranged at a central location of the base body.

7. The light source assembly according to claim 1, further comprising:

a driving device arranged to drive the light emitting component to emit light, wherein a connector is provided on the first surface of the base body and electrically connected to the driving device by a harness.

8. The light source assembly according to claim 1, wherein the base body is provided with one or more mounting holes penetrating the first surface and the second surface, for being connected to a light guide device.

9. The light source assembly according to claim 1, wherein the base body is made from thermoconductive plastic which is electrically isolated or dielectric.

10. The light source assembly according to claim 1, wherein the base body and the at least two metal holding members are formed in a single piece.

11. A signal lamp for an automobile vehicle, the signal lamp comprising:

a housing;

an outer lens, the outer lens and the housing in combination enclosing an internal space of the signal lamp; and the light source assembly according to claim 1, the light source assembly located in the internal space of the signal lamp and arranged to emit a signaling light which exits the signal lamp through the outer lens.

12. The signal lamp according to claim 11, further comprising a light guide device located in the internal space of the signal lamp and arranged to receive the signaling light emitted from the light source assembly and to direct the signaling light towards the outer lens, wherein the base body is provided with one or more mounting holes penetrating the first surface and the second surface and the light guide device is connected to the light source assembly via the one or more mounting holes.

13. The signal lamp according to claim 12, further comprising a bezel located at an inner side of the outer lens and fixed to the outer lens, wherein the light guide device is provided with a connecting tab, by which the light guide device is fixed to the bezel.

14. The signal lamp according to claim 11, wherein the signal lamp is a center high mounted stop lamp, a rear stop lamp, a direction indicator lamp or a position lamp.

15. A method for producing a light source assembly, the method comprising:

forming at least two metal holding members, the at least two metal holding members having a light source holding part extending in a first direction and one or more penetration parts extending in a second direction crossing the first direction;

putting the at least two metal holding members in a die cavity and injecting a material for a base body into the die cavity to form the base body of the light source assembly on a side of the light source holding part by injection molding, the base body being penetrated therethrough by the penetration part of the at least two metal holding members that are adjacent to each other and non-overlapping; and mounting a light emitting component on the side of the light source holding part of the at least two metal holding members opposite to the base body.

16. The method according to claim 15, wherein the at least two metal holding members include a first metal holding member and a second metal holding member spaced apart from each other, the light emitting component has two electrodes, and the mounting comprises electrically connecting the two electrodes of the light emitting component to the first metal holding member and the second metal holding member respectively.

17. The method according to claim 15, wherein the putting comprises forming base body radiating fins on a side of the base body facing away from the light source holding part.

18. The method according to claim 15, wherein the putting comprises forming a connector socket for the light emitting component on the base body.

19. The method according to claim 18, further comprising:

producing a driving device for driving the light emitting component and soldering one end of a harness to the driving device; and connecting another end of the harness to the connector socket on the base body.

20. The method according to claim 15, wherein the putting comprises forming one or more mounting holes in the base body, for connecting a light guide device.

* * * * *